US007927084B2

(12) United States Patent
Khoo et al.

(10) Patent No.: US 7,927,084 B2
(45) Date of Patent: Apr. 19, 2011

(54) MAGNETIC TRAP FOR FERROUS CONTAMINANTS IN LUBRICANT

(75) Inventors: Chew Thong Khoo, Singapore (SG); Kah Seng Tan, Singapore (SG); Ching Khoon Yeoh, Singapore (SG); Seow Khee Phua, Singapore (SG); Tai Ping Voon, Singapore (SG); Yuji Mori, Singapore (SG)

(73) Assignee: Panasonic Corporation, Kadoma-shi (JP)

( * ) Notice: Subject to any disclaimer, the term of this patent is extended or adjusted under 35 U.S.C. 154(b) by 480 days.

(21) Appl. No.: 11/574,540

(22) PCT Filed: Sep. 29, 2006

(86) PCT No.: PCT/SG2006/000291

§ 371 (c)(1),
(2), (4) Date: Apr. 17, 2007

(87) PCT Pub. No.: WO2007/061385

PCT Pub. Date: May 31, 2007

(65) Prior Publication Data

US 2009/0252631 A1 Oct. 8, 2009

(30) Foreign Application Priority Data

Nov. 25, 2005 (SG) ..... 200507523

(51) Int. Cl.
*F04C 29/02* (2006.01)

(52) U.S. Cl. ..... 418/94; 418/55.6; 418/88; 418/89; 184/6.18; 184/6.25

(58) Field of Classification Search ..... 418/1, 55.6, 418/88, 89, 46, 94; 184/6.18, 6.25, 6.24
See application file for complete search history.

(56) References Cited

U.S. PATENT DOCUMENTS

| | | | | |
|---|---|---|---|---|
| 5,345,785 | A * | 9/1994 | Sekigami et al. | 418/55.6 |
| 5,372,490 | A | 12/1994 | Fain | |
| 5,842,420 | A * | 12/1998 | Khoo et al. | 184/6.18 |
| 6,039,550 | A | 3/2000 | Friedley et al. | |
| 6,227,828 | B1 * | 5/2001 | Takeuchi et al. | 418/88 |
| 6,290,479 | B1 | 9/2001 | Friedley et al. | |
| 6,457,562 | B1 | 10/2002 | Sun | |
| 6,484,847 | B2 | 11/2002 | Paczuski | |
| 6,558,541 | B1 * | 5/2003 | Morrison | 184/6.25 |
| 6,607,372 | B2 * | 8/2003 | Fukuoka | 184/6.18 |
| 2006/0057010 | A1 * | 3/2006 | Tsubono et al. | 418/55.6 |

FOREIGN PATENT DOCUMENTS

| | | | |
|---|---|---|---|
| DE | 26 03 230 | | 8/1977 |
| JP | 62-26394 | | 2/1987 |
| JP | 63 80082 | | 4/1988 |
| JP | 03115791 | A * | 5/1991 |
| JP | 4 262088 | | 9/1992 |
| JP | 04262088 | A * | 9/1992 |

* cited by examiner

*Primary Examiner* — Thomas E Denion
*Assistant Examiner* — Mary A Davis
(74) *Attorney, Agent, or Firm* — Oblon, Spivak, McClelland, Maier & Neustadt, L.L.P.

(57) ABSTRACT

A compressor is having a tubular vertical shaft, which rotates about its vertical axis, a cylinder block for supporting the tubular vertical shaft, a rotor for driving the rotation of the tubular vertical shaft, and a stator affixed to the cylinder block. Lubricant is channelled from the lower end of the tubular vertical shaft through an inlet of its interior path to the outlet. A magnet is disposed within the interior path to trap ferrous contaminants in the lubricant before the lubricant is distributed to other parts of the compressor.

13 Claims, 7 Drawing Sheets

MAGNETIC TRAP FOR FERROUS CONTAMINANTS IN LUBRICANT

FIELD OF THE INVENTION

The present invention relates to hermetic compressors, in particular the prevention of ferrous lubricant contaminants from coming into contact with components of the compressor and damaging the components, which eventually leads to stalling of the compressor.

BACKGROUND OF THE INVENTION

Hermetic compressors are used in household refrigerators, freezers, and air-conditioning units for compressing the refrigerant in a closed-looped refrigeration system. Lubrication of frictional components in the compressor is provided by a crankshaft, which draws lubricant from an oil sump at the shell bottom and circulates it to the various parts of the compressor.

The crankshaft is driven by a rotating drive and the rotation of the crankshaft draws the lubricant and circulates the lubricant to various parts of the compressor. As the lubricant is circulated throughout the compressor, it picks up debris and particles in the compressor generated from the manufacturing process or wear and tear of parts in the compressor. As the lubricant is circulated back into the compressor, the debris and particles in the lubricant may damage components of the compressor and result in failure of the compressor.

It is therefore highly desirable to minimize the presence of debris and particles in the lubricant before the lubricant gets circulated throughout the compressor. Magnets have been used to separate the debris from the lubricant. FIG. 1 shows a prior art document of U.S. Pat. No. 6,290,479 B1 (hereinafter Friedley) where a magnet is utilized to separate the debris from the lubricant.

In Friedley, an annular magnet 88 is set within the depression of a lower shell 80 of the compressor 10 to separate ferrous material from the lubricant. In operation, oil is drawn into an oil pick-up tube 62 by the centrifugal action of a drive shaft 40 and transported to an oil distribution bore 66 formed through drive shaft 40. The lubricant is then distributed to different parts of the compressor 10 for lubrication of the different components. The suction draws oil 80 from a sump 64 radically inwards to the axis 86. Since all of the oil used for lubrication must enter the end 94 of the oil pick-up tube 62, all of the oil will flow within close proximity to the upper surface of the annular magnet 88.

As such, the annular magnet 88 traps ferrous debris and particles present in the lubricant before the lubricant gets drawn into the oil pick-up tube 62, thereby preventing contaminated lubricant from being distributed throughout parts of the compressor 10. However, debris and particles that are present within the drive shaft 40, such as burrs from the manufacturing process of the drive shaft 40, will not be filtered away. The debris and particles from within the shaft will be distributed with the lubricant throughout parts of the compressor 10 and cause damage to the bearings and other critical moving components. For the annular magnet 88 to work well, it has to be placed close to the end 94 of the oil pick-up tube 62, since the debris and particles in the oil are in constant motion caused by the rotating motion of the oil pick-up tube 62.

The existence of debris and particles in the lubricant is a chronic problem in compressors that needs to be addressed. Therefore, a need clearly exists for an enhanced method of reducing the contamination of lubricant due to debris and particles generated or are already present in the compressor and compressor parts.

SUMMARY OF THE INVENTION

The present invention seeks to provide a compressor comprising a tubular vertical shaft rotatable about its vertical axis, the tubular vertical shaft further comprises an interior path extending upwardly for channelling lubricant drawn in from a lower end of the tubular vertical shaft and at least one magnet disposed within the interior path for separating ferrous contaminants from the lubricant before the lubricant leaves the interior path.

Accordingly, in one aspect, the present invention provides a method of trapping ferrous materials in a compressor. The method comprising the steps of a) providing a compressor having a tubular vertical shaft rotatable about its vertical axis, the tubular vertical shaft further comprises interior path extending upwardly for channelling lubricant drawn in from a lower end of the tubular vertical shaft, the interior path having an inlet at a lower end and an outlet at the higher end; and b) placing and securing at least one magnet at the surface of the interior path for separating ferrous contaminants from the lubricant before the lubricant leaves the interior path, wherein the at least one magnet is placed and secured within the interior path, such that the outlet is unobstructed.

BRIEF DESCRIPTION OF THE DRAWINGS

A preferred embodiment of the present invention will now be more fully described, by way of example, with reference to the drawings of which.

DETAILED DESCRIPTION OF THE DRAWINGS

A preferred embodiment of the invention is described. In the following description, details are provided to describe the preferred embodiment. It shall be apparent to one skilled in the art, however, that the invention may be practiced without such details. Some of these details may not be described at length so as not to obscure the invention.

Figure 1:
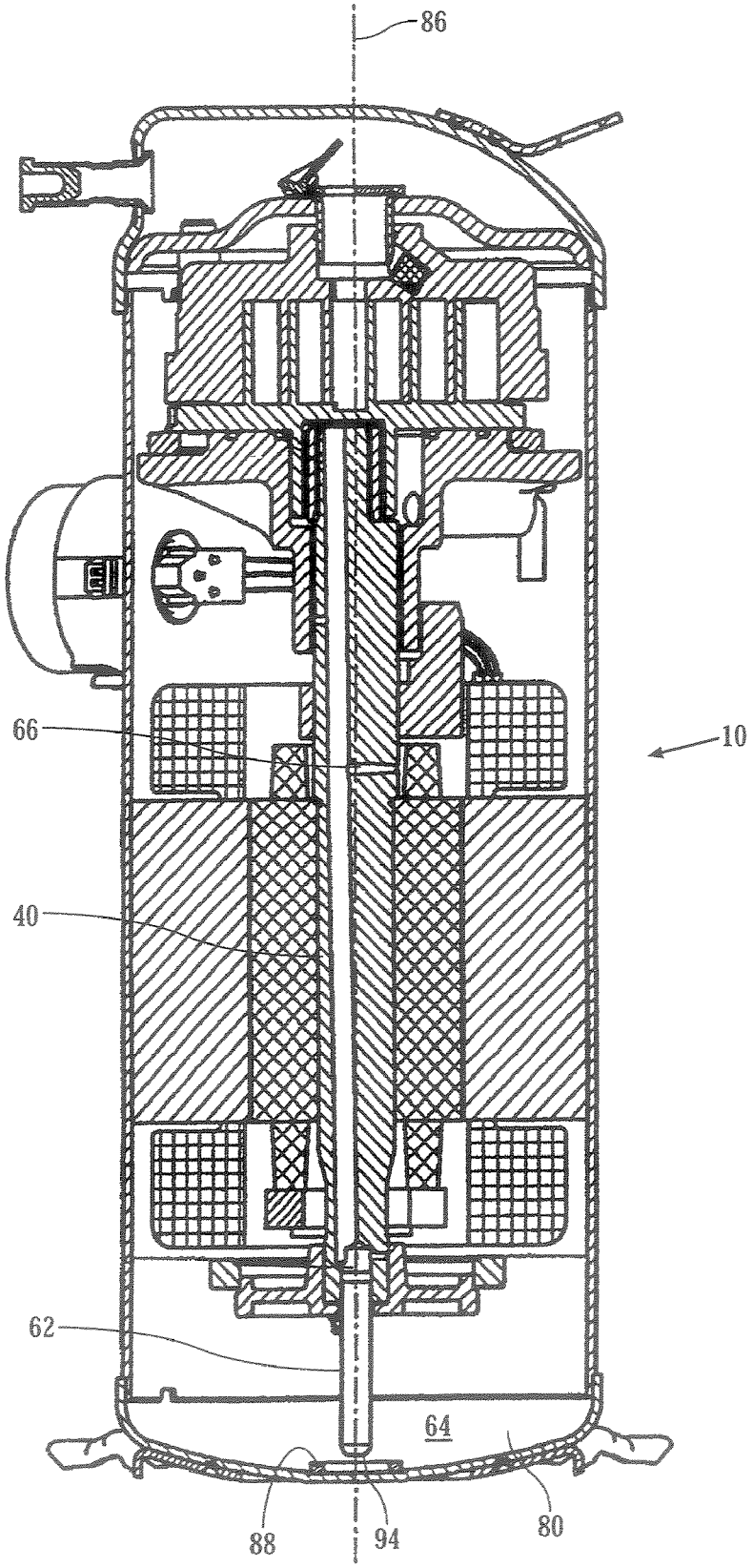
FIG. 1 (PRIOR ART)
FIG. 1 illustrates a vertical cross-sectional view of a scroll compressor of U.S. Pat. No. 6,290,479 B1.
Figure 2:
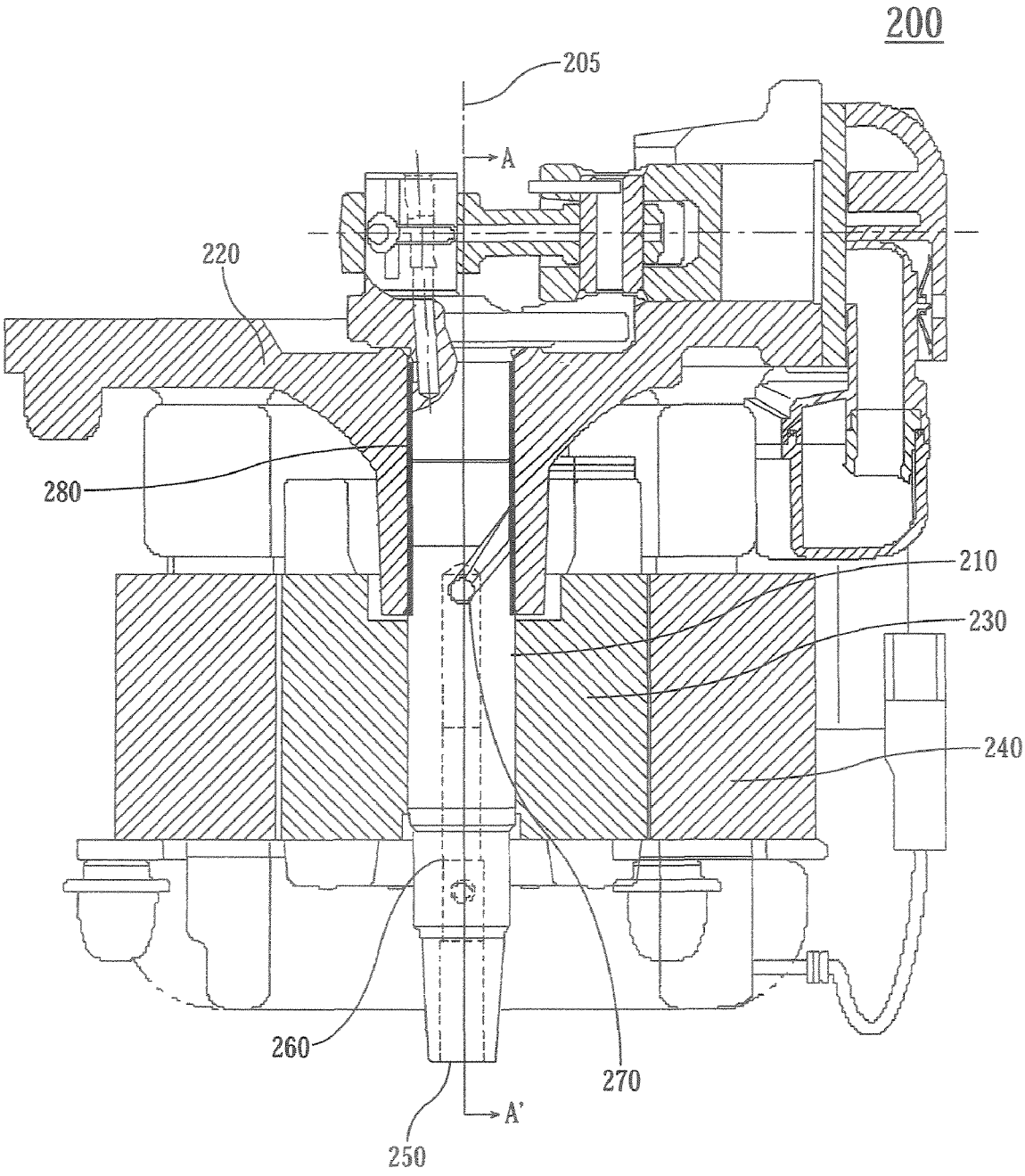
FIG. 2 illustrates a vertical cross-sectional view of a compressor in accordance with the present invention.

Referring to FIG. 2, an illustration is shown of a vertical cross-sectional view of an embodiment of a compressor 200 in accordance with the present invention. The compressor 200 is shown having a tubular vertical shaft 210, which rotates about its vertical axis 205. The compressor 200 further comprises a cylinder block 220 for supporting the tubular vertical shaft 210, a rotor 230 for driving the rotation of the tubular vertical shaft 210, and a stator 240 affixed to the cylinder block 220. The cylinder block 220 and the tubular vertical shaft 210 can be made of cast iron or low carbon steel.

The cylinder block 220 has a cylindrical bore 280 in which the tubular vertical shaft 210 is supported. The radial clearance between the cylindrical bore 280 and the tubular vertical shaft 210 is approximately 4 μm to 12 μm. Any debris or particles trapped between the cylindrical bore 280 and the tubular vertical shaft 210 will damage the surfaces of the cylindrical bore 280 and the tubular vertical shaft 210, thereby generating more debris and particles.

During rotation of the tubular vertical shaft 210, centrifugal force draws the lubricant at the lower end of the tubular vertical shaft 210 through an inlet 250 and conducts the lubricant upwards. The lubricant is channelled through an interior path 260 (shown in dotted lines in FIG. 2) extending upwardly within the tubular vertical shaft 210 and out through an outlet 270 to lubricate the various parts of the compressor 200.

The interior path 260 has a lower end and a higher end. The inlet 250 is situated at the lower end of the interior path 260, communicating with the lower end of the tubular vertical shaft 210. The outlet 270 of the interior path 260 is situated at the higher end of the interior path 260, communicating between the circumferential surface of the interior path 260 and the exterior surface of the tubular vertical shaft 210.

Figure 3:
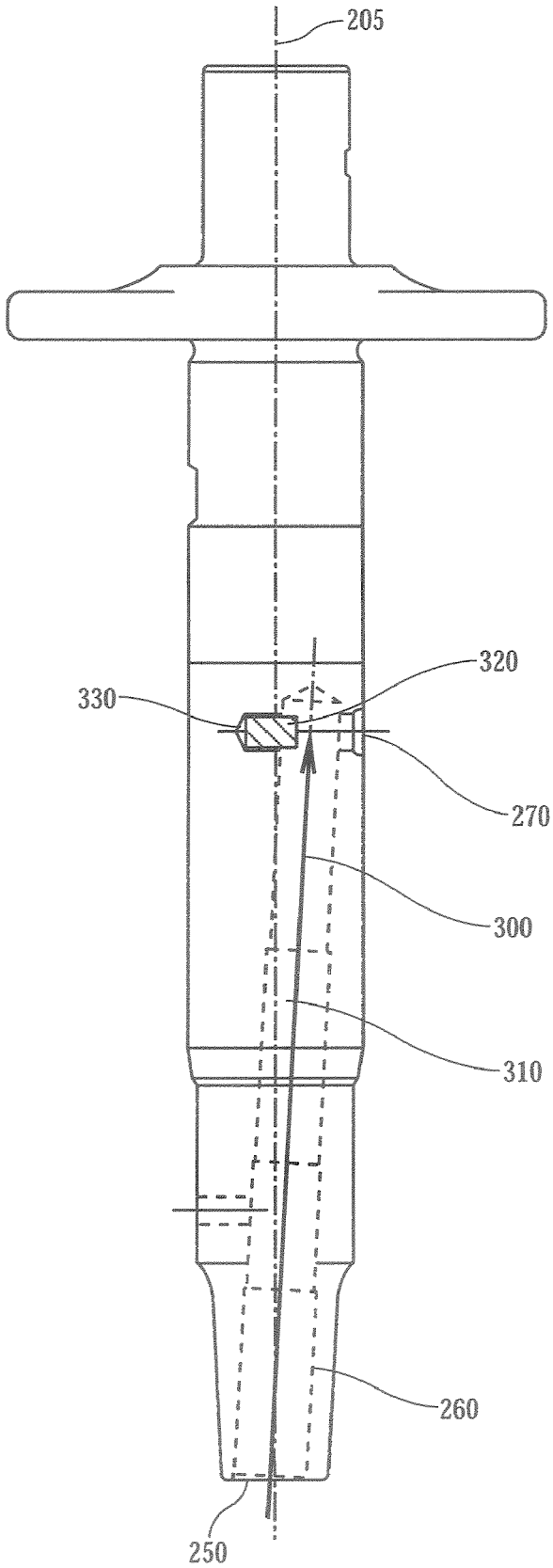
FIG. 3 illustrates a first embodiment of the enlarged cross-sectional view of a tubular vertical shaft in the compressor taken along line A-A' in FIG. 2.

Referring to FIG. 3, an enlarged cross-sectional view of the tubular vertical shaft 210 in the compressor 200 taken along line A-A' in FIG. 2 is shown. The central longitudinal axis 300 of the interior path 260 is at an angle 310 to the vertical axis 205 of the tubular vertical shaft 210. The angle 310 is approximately 2.5° to 3.5°.

When the tubular vertical shaft 210 rotates, centrifugal force generated will draw the lubricant through the inlet 250 and conduct the lubricant upwards along the interior path 260. The lubricant is then distributed from the outlet 270 of the tubular vertical shaft 210 to other parts of the compressor 200.

At least one magnet 320 is disposed along the interior path 260 such that flow of lubricant through the outlet 270 is unobstructed by the magnet 320. The magnet 320 attracts ferrous materials and particles such as burs in the lubricant before the lubricant is distributed out of the interior path 260. In this way, the magnet 320 traps the ferrous contaminants, which damage parts of the compressor 200, and separates the ferrous contaminants from the lubricant before the lubricant is released into the compressor.

Figure 4:
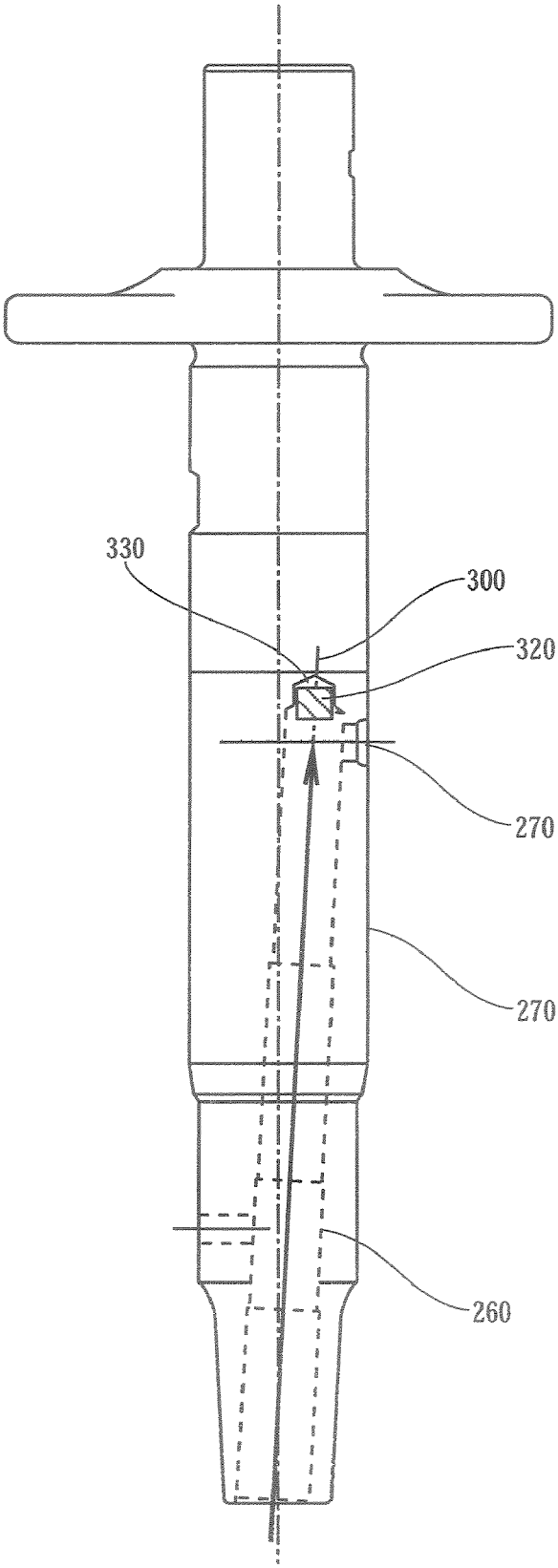
FIG. 4 illustrates a second embodiment of the enlarged cross-sectional view of a tubular vertical shaft in the compressor taken along line A-A' in FIG. 2.
Figure 5:
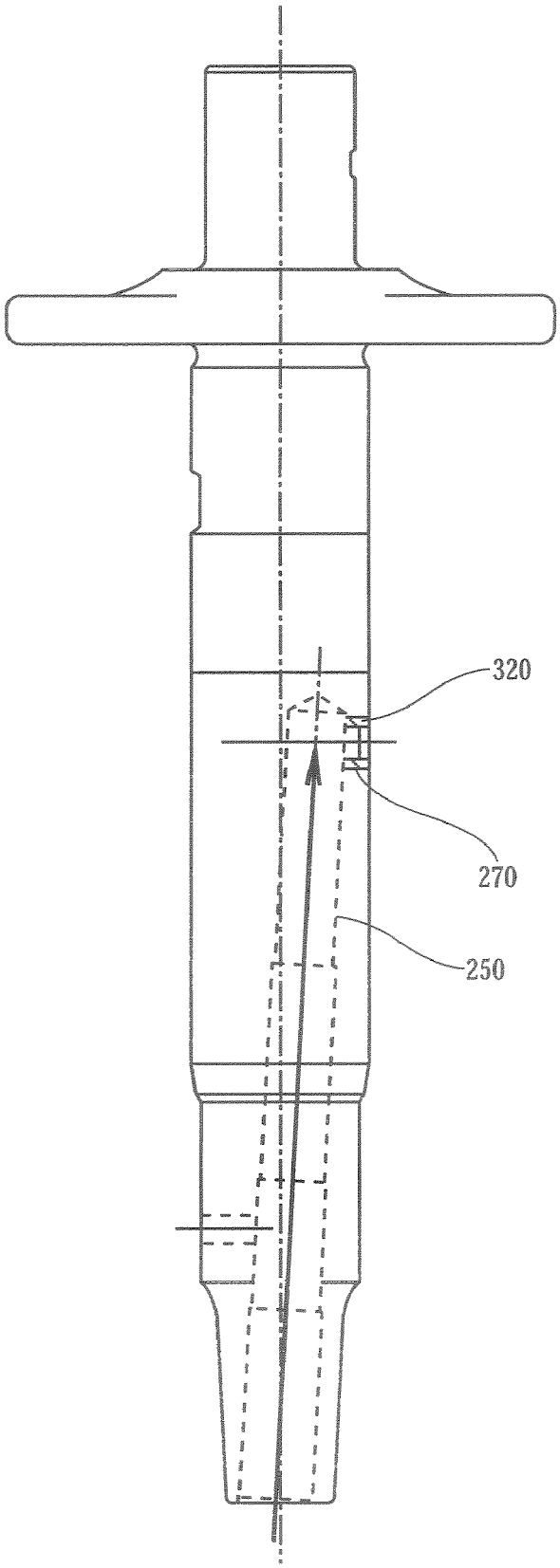
FIG. 5 illustrates a third embodiment of the enlarged cross-sectional view of a tubular vertical shaft in the compressor taken along line A-A' in FIG. 2.

In an embodiment of the present invention as shown in FIG. 3, the magnet 320 is disposed at the circumferential surface of the interior path 260 opposite the outlet 270. In another embodiment of the present invention as shown in FIG. 4, the magnet 320 is disposed at the surface of the higher end of the interior path 260 on the central longitudinal axis 300. In yet another embodiment of the present invention as shown in FIG. 5, an annular magnet 320 is disposed within the outlet 270. The annular magnet 320 is having a through hole, through which lubricant may flow. The outer circumference of the annular magnet 320 corresponds with the circumference of the outlet 270, such that the annular magnet 320 is fittingly disposed within the outlet.

Figure 6:
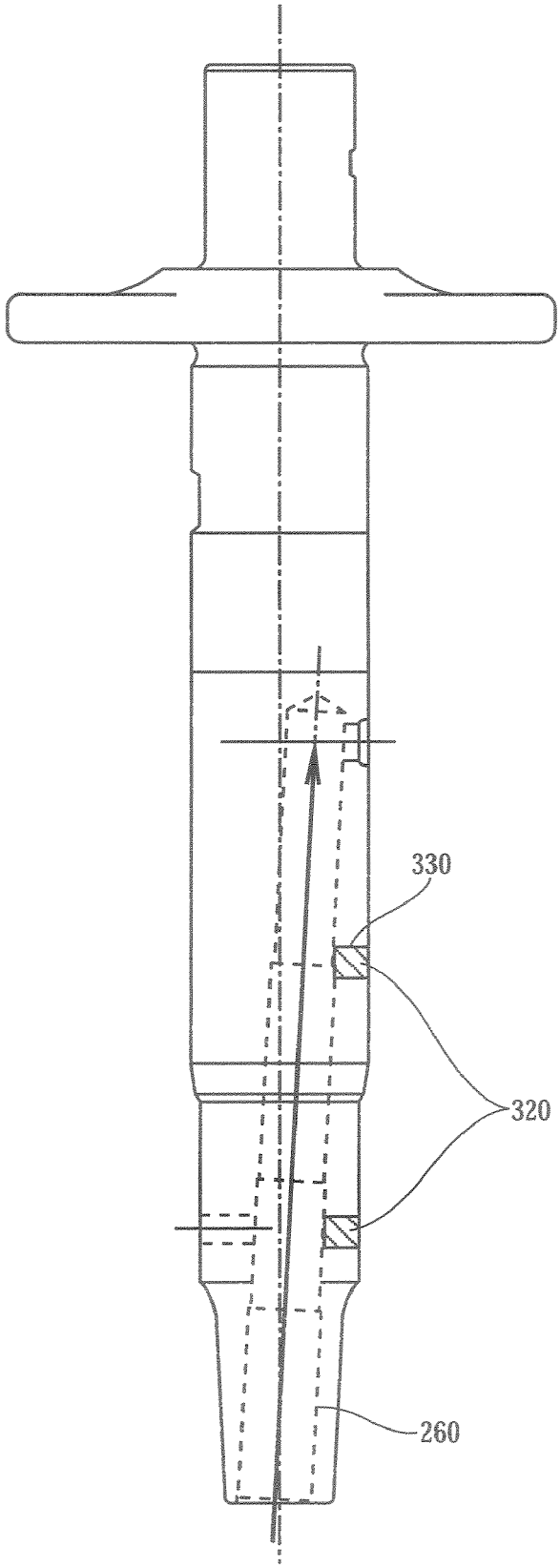
FIG. 6 illustrates a fourth embodiment of the enlarged cross-sectional view of a tubular vertical shaft in the compressor taken along line A-A' in FIG. 2.

In yet another embodiment of the present invention as shown in FIG. 6, at least one magnet 320 is disposed at various locations along the entire circumferential surface of the interior path 260. At least one cavity is provided at various locations along the entire circumferential surface of the interior path 260. The at least one magnet 320 is disposed within the at least one cavity.

An example of a way to secure the magnet to the interior path 260 is to provide a cavity 330 on the surface of the interior path 260 at the location where the magnet 320 is to be located, and having the magnet 320 fittingly disposed within the cavity 330. The magnet 320 is thus secured in place by its own magnetic force. The dimensions of the cavity 330 correspond with the dimension of the magnet 320. To ensure long-term reliability and performance, rare earth permanent magnet Neodymium-Iron-Boron (Nd—Fe—B) may be used.

Figure 7:
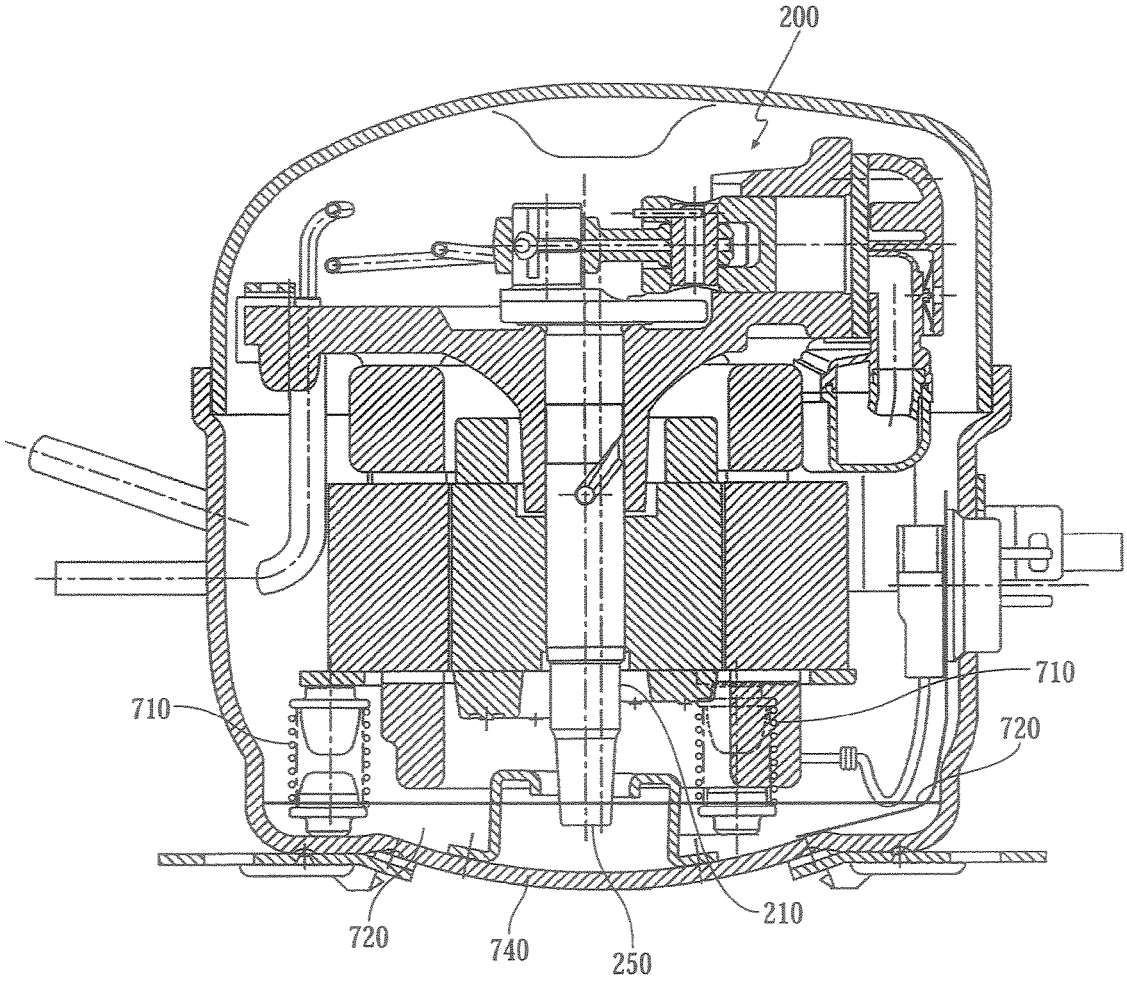
FIG. 7 illustrates a vertical cross-sectional view of a compressor in accordance with the present invention supported by springs in a housing.

Referring to FIG. 7, in the preferred embodiment of the invention, the compressor 200 is supported by suspension springs 710 due to vertical and horizontal displacements of the compressor during operation. Lubricant 720 is contained at a bottom sump 740 of the compressor 200. As such, a significant clearing. between the inlet 250 is necessary so that the lower end of the tubular vertical shaft 210 will not be hitting against the bottom sump 740. Placing a magnet at the bottom sump 740 of the compressor 200 is thus ineffective due to the significant clearance between the inlet 250 and the bottom sump 740. Ferrous debris and contaminants will enter the tubular vertical shaft 210 undetected by the magnet as the magnet is placed at a distance away from the inlet 250.

It will be appreciated that although one preferred embodiment has been described in detail, various modifications and improvements can be made by a person skilled in the art without departing from the scope of the present invention.

The invention claimed is:

1. A compressor comprising:

a tubular vertical shaft rotatable about its vertical axis, the tubular vertical shaft further including, an interior surface defining an interior path extending longitudinally upwardly within the tubular vertical shaft for channeling lubricant drawn in from a lower end of the tubular vertical shaft, at least one cavity disposed in the interior surface, and a magnet fittingly disposed within the at least one cavity for separating ferrous contaminants from the lubricant before the lubricant leaves the interior path, wherein dimensions of the at least one cavity correspond to dimensions of the magnet and at least a part of the magnet contacts the interior path of the tubular vertical shaft.

2. The compressor of claim 1, wherein a longitudinal axis of the interior path is at an angle with a vertical axis of the tubular vertical shaft, and a flow of the lubricant is not obstructed by the magnet.

3. The compressor of claim 2, wherein the interior path includes an inlet at the lower end and an outlet at a higher end.

4. The compressor of claim 3, wherein the inlet is at the lower end of the tubular vertical shaft and the outlet communicates between the circumferential surface of the interior path and the exterior surface of the tubular vertical shaft.

5. The compressor of claim 2, wherein the angle is between 2.5° and 3.5°.

6. The compressor of claim 1, wherein the at least one cavity includes a plurality of cavities disposed circumferentially in the interior surface, each of the plurality of cavities having the respective magnet disposed therein.

7. The compressor of claim 1, wherein the tubular vertical shaft is supported by a cylinder block.

8. The compressor of claim 1, wherein the rotation of the tubular vertical shaft is driven by a rotor.

9. The compressor of claim 1, wherein the magnet is a rare earth permanent magnet Neodymium-Iron-Boron.

10. A method of trapping ferrous materials in a compressor, the method comprising the steps of:

a) providing a compressor having a tubular vertical shaft rotatable about its vertical axis, the tubular vertical shaft further includes, an interior surface defining an interior path extending longitudinally upwardly within the tubular vertical shaft for channeling lubricant drawn in from a lower end of the tubular vertical shaft, at least one cavity disposed in the interior surface, the interior path having an inlet at a lower end and an outlet at the higher end, and b) fittingly securing a magnet within the at least one cavity in the surface of the interior path for separating ferrous contaminants from the lubricant before the lubricant leaves the interior path, wherein dimensions of the at least one cavity correspond to dimensions of the magnet and at least a part of the magnet contacts the interior path of the tubular vertical shaft.

11. The method of claim 10, wherein a flow of the lubricant is not obstructed by the magnet.

12. The method of claim 10, wherein the at least one cavity includes a plurality of cavities, the tubular vertical shaft further includes the plurality of cavities disposed circumferentially in the interior surface, and step b) further includes fittingly securing the respective magnet in each of the cavities.

13. The method of claim 10, wherein one of the at least one cavity is located at a surface of the higher end of the interior path.

* * * * *